US005940903A

United States Patent [19]

Yemini

[11] Patent Number: 5,940,903

[45] Date of Patent: Aug. 24, 1999

[54] ADJUSTABLE BATH ACCESSORY

[75] Inventor: Zvi Yemini, Tel Aviv, Israel

[73] Assignee: Melard Manufacturing Corporation, Passaic, N.J.

[21] Appl. No.: 08/786,608

[22] Filed: Jan. 21, 1997

[51] Int. Cl.[6] ..... A47K 3/00

[52] U.S. Cl. ..... 4/559; 4/539

[58] Field of Search ..... 4/559, 539, 553, 4/554, 639, 640, 641, 642

[56] References Cited

U.S. PATENT DOCUMENTS

| | | |
|---|---|---|
| D. 164,875 | 10/1951 | Perez . |
| D. 171,921 | 4/1954 | Goodman . |
| D. 191,573 | 10/1961 | Perchalski . |
| D. 355,553 | 2/1995 | Tiramani . |
| 1,854,987 | 4/1932 | Fradl . |
| 2,045,965 | 6/1936 | Rosen . |
| 2,167,795 | 8/1939 | Bentz . |
| 2,659,491 | 11/1953 | Williams . |
| 3,213,565 | 10/1965 | Grosz . |
| 3,239,850 | 3/1966 | Kiss . |
| 3,444,564 | 5/1969 | Lavacchia . |
| 4,053,954 | 10/1977 | Chapman . |
| 4,098,486 | 7/1978 | Hornsby . |
| 4,472,843 | 9/1984 | Chermak . |
| 4,525,882 | 7/1985 | Stenberg . |
| 4,975,991 | 12/1990 | Petereson ..... 4/579 |
| 5,381,564 | 1/1995 | Carroll . |

*Primary Examiner*—David J. Walczak
*Attorney, Agent, or Firm*—Edgar A. Zarins; Leon E. Redman; Myron B. Kapustij

[57] ABSTRACT

An accessory for a bathtub adapted to fit over the side wall of the tub for convenient access to soaps, shampoos and other bath items. The bath accessory is telescopically adjustable to fit over bath walls of different widths and removable for storage. The accessory tray includes a pair of similar halves telescopically connected for adjustment. In a preferred embodiment, each half includes a well to hold bottles and the like while also creating depth extending down the bath wall for stability. Additional features may include a soap tray and pegs for additional bath items.

12 Claims, 1 Drawing Sheet

ADJUSTABLE BATH ACCESSORY

BACKGROUND OF THE INVENTION

I. Field of the Invention

This invention relates to an accessory tray for holding bath items and, in particular, to a tray adjustable to fit over the edge of a bathtub or to stand freely while retaining bath items in a convenient location.

II. Description of the Prior Art

Convenience accessories for the tub and shower have become increasingly popular to retain bath items such as soaps, shampoos, razors, washcloths, etc. Various product configurations are easily molded from lightweight plastics to incorporate such features. This product category including shower caddies which hang from the shower arm and shelving units which adhesively mount within a corner or wall of the bath. Convenient features incorporated into such devices include soap trays which keep the soap from getting soft, hooks for washcloths, deeper wells to retain bottles of shampoo, conditioners and the like, and retainers for small items such as razors.

While such items provide their own specific function they are limited to predetermined areas of the bath or shower. Shower caddies must be hung from the showerhead to prevent tipping. Corner units are typically mounted to the wall with adhesive strips preventing convenient removal. As a result, these devices remain in the bath unit along with the soaps and shampoos repeatedly subject to spray from bathing. Furthermore, in freestanding baths it may be unsightly to leave shampoo bottles and soaps in full view requiring removal of the individual items.

SUMMARY OF THE INVENTION

The present invention overcomes the disadvantages of the prior known bath accessories by providing an accessory tray adjustable to fit over the edge of a bathtub yet easily removable.

The present invention includes a tray for holding a wide variety of bath items convenient to the bather by fitting over the edge of the tub. The tray is longitudinally adjustable to fit over bath edges of different widths. Additionally, the tray will stand freely to allow storage of the entire unit along with the bath items. The two halves are telescopically connected for adjustment of the space between the end wells of the tray to accommodate the wall of the tub. The wells form legs which straddle the bathtub wall and provide stability on a flat surface. Convenience features such as soap trays and apertures for razors and the like are molded into the body of the tray.

In order to facilitate telescopic mating between the halves of the accessory, a first half is provided with a rim flange which is slidably received within a C-channel of a second half of the tray. The rim flange extends along a tongue portion of the first half which is received in a substantially U-shaped portion of the second half. In a preferred embodiment, a soap tray is formed in the tongue portion of the first half of the tray.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
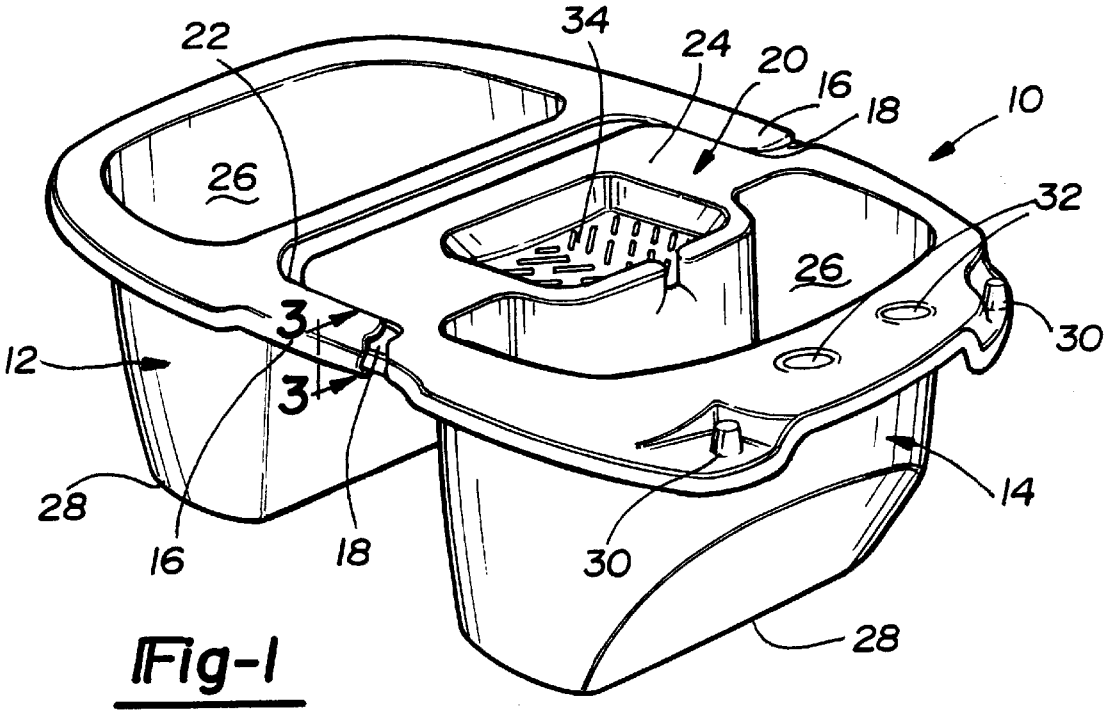
FIG. 1 is a perspective view of an adjustable bath accessory embodying the present invention.
Figure 2:
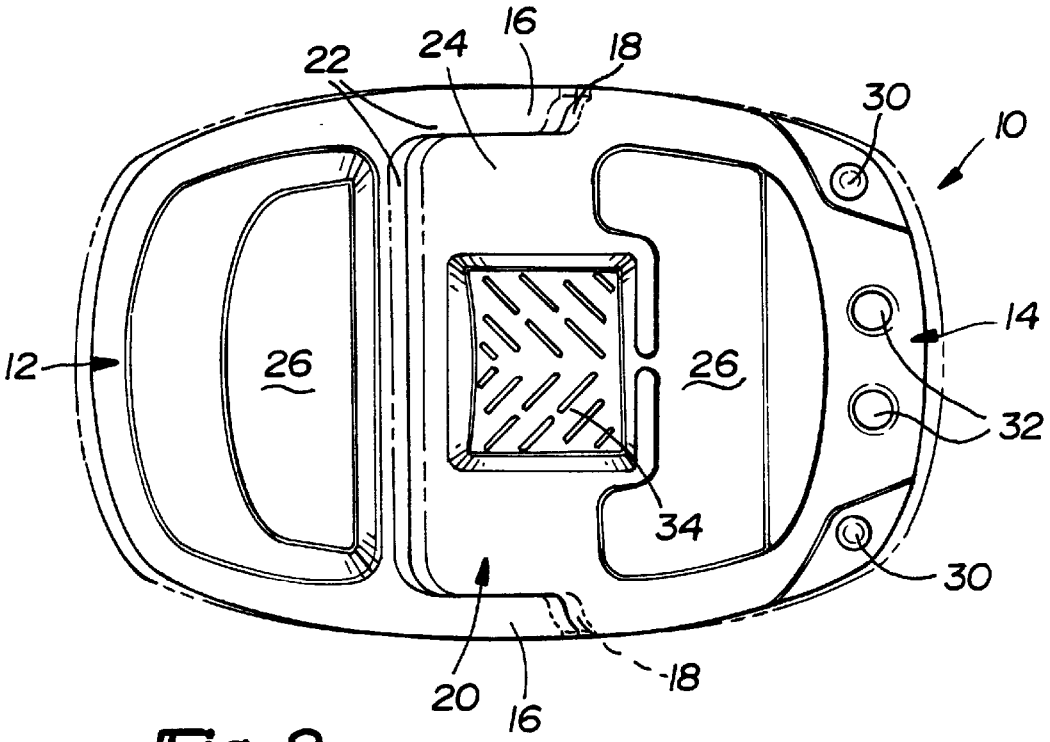
FIG. 2 is a top plan view thereof.

Referring first to FIGS. 1 and 2, there is shown an accessory 10 for the bath adapted to fit over or straddle a wall of the bathtub (not shown). As an added feature, the accessory tray 10 may be removed from the bath with all of its contents for convenient storage. As is typical of bath accessories, the tray 10 of the present invention can accommodate a wide variety of bath products such as soap, shampoos and other bottled products, razors, washcloths, etc. However, the present invention provides the convenience of fitting onto a variety of bathtubs yet has sufficient stability to stand on a flat surface. While the bath tray 10 of the present invention will be described in connection with certain features which are desirable to the bather, it is to be understood that the accessory may be molded with any combination of features without departing from the scope and spirit of the invention. The present invention provides an adjustable tray to allow the accessory 10 to fit over the edge of the bathtub yet have sufficient stability to be freestanding during storage. As a result, the accessory tray 10 does not need to be emptied between uses.

Figure 3:
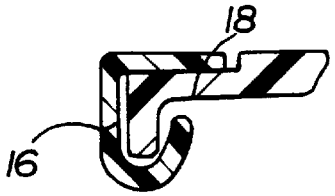
FIG. 3 is a cross-sectional view taken along lines 3—3 of FIG. 1.

The bath accessory 10 of the present invention includes a pair of telescopically connected sections 12 and 14 which generally form opposing halves of the tray 10. The sections 12 and 14 are matingly connected to facilitate sliding expansion and contraction of the accessory 10 as described. A first section 12 includes a channel 16 which matingly receives a flange 18 of a second section 14 as best shown in FIG. 3. In a preferred embodiment as shown in FIGS. 1 and 3, the mating channel 16 and flange 18 are formed along outer edges on opposite sides of the tray 10 and specifically along the sides of an intermediate section 20 of the accessory tray 10. Each of the sections 12 and 14 include a lip 22 and 24, respectively, which join to form the intermediate section 20. Accordingly, the lip 22 of the first section 12 includes outer channels 16 which matingly cooperates with outer flanges 18 forming a part of the lip 24 of second section 14 to allow telescoping longitudinal adjustment of the length of the tray 10.

The overall configuration of the accessory 10 lends itself to being saddled over the edge of the bathtub. In a preferred embodiment, each section 12 and 14 includes a well 26 for retaining tall items such as bottles of shampoo, conditioner, etc. The wells 26 form the legs of the tray 10 extending down opposite sides of the bathtub wall. The bottoms 28 of the wells 26 are flat to provide a stable base during storage.

The accessory tray 10 incorporates a variety of features for added convenience for the user. Pegs 30 may be molded into the tray 10 on which washcloths or the like may be hung. Apertures 32 allow insertion of razors or similar items. A soap dish 34 is molded in the intermediate section 20 to conveniently retain a bar of soap. Additional features may be molded into the accessory tray 10 without departing from the scope of the present invention.

The foregoing detailed description has been given for clearness of understanding only and no unnecessary limitations should be understood therefrom as some modifications will be obvious to those skilled in the art without departing from the scope and spirit of the appended claims.

What is claimed is:

1. A bath accessory tray comprising:

first and second tray sections telescopically connected for facilitating longitudinal adjustment of a length of said tray, said first and second sections forming a substantially planar tray surface and including wells formed by depending portions extending downwardly below said planar tray surface forming a space therebetween such that longitudinal adjustment of said tray varies said space between said depending portions of said first and second sections wherein said space is adapted to receive a member between said depending portions.

2. The tray as defined in claim 1 wherein said first and second sections each include a lip cooperating to form an intermediate portion of said tray, said intermediate portion disposed between said wells of said first and second sections.

3. The tray as defined in claim 2 wherein said lip of said first section includes a channel and said lip of said second section includes a flange, said flange slidably received within said channel to telescopically connect said first and second sections.

4. The tray as defined in claim 3 wherein said channel of said first section is formed along opposite outer edges of said lip of said first section and said flange of said second section is formed along opposite outer edges of said lip of said second section.

5. The tray as defined in claim 4 and further comprising a soap dish formed in said lip of said second section.

6. A bath accessory tray comprising:

a first tray section having a lip and a well forming a first depending portion of said first tray section;

a second tray section having a lip and a well forming a second depending portion of said second tray section; and means for selectively connecting said lips of said first and second tray sections to form a substantially planar tray surface for selective longitudinal expansion and contraction such that a space between said first and second depending portions may be selectively adjusted to accommodate a member between said depending portions for mounting said tray to said member, said depending portions extending downwardly beneath said planar tray surface.

7. The tray as defined in claim 6 wherein said depending portions have a flat bottom surface.

8. The tray as defined in claim 6 wherein said lip of said first section includes inwardly disposed channels along opposite outer edges of said first section.

9. The tray as defined in claim 8 wherein said lip of said second section includes flanges along opposite outer edges of said second section, said means for slidably connecting said tray sections including said flanges matingly received within said channels for telescopic adjustment of said first section relative to said second section.

10. A bath accessory tray adapted to be selectively mounted to a member of a bath, said tray comprising:

a first tray section having a lip and a well forming a first depending portion of said first tray section;

a second tray section having a lip and a well forming a second depending portion of said second tray section; and means for slidably connecting said lips of said first and second tray sections to form a substantially planar tray surface having said first and second depending portions extending downward from said planar surface said first and second tray sections capable of longitudinal expansion and contraction of said tray to adjust a space between said first and second depending portions thereby accommodating the bath member between said depending portions such that the bath member is adapted to be disposed within said space beneath said planar tray surface.

11. The tray as defined in claim 10 wherein said lip of said first section includes inwardly disposed channels along opposite outer edges of said first section.

12. The tray as defined in claim 11 wherein said lip of said second section includes flanges along opposite outer edges of said second section, said means for slidably connecting said tray sections including said flanges matingly received within said channels for telescopic adjustment of said first section relative to said second section.

* * * * *